US009724805B2

(12) United States Patent
Ramanath et al.

(10) Patent No.: US 9,724,805 B2
(45) Date of Patent: Aug. 8, 2017

(54) ABRASIVE ARTICLE WITH HYBRID BOND

(71) Applicants: SAINT-GOBAIN ABRASIVES, INC., Worcester, MA (US); SAINT-GOBAIN ABRASIFS, Conflans-Sainte-Honorine (FR)

(72) Inventors: Srinivasan Ramanath, Holden, MA (US); Rachana Upadhyay, Shrewsbury, MA (US); Robert F. Corcoran, Jr., Holden, MA (US); Cong Wang, Evanston, IL (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 162 days.

(21) Appl. No.: 14/316,848

(22) Filed: Jun. 27, 2014

(65) Prior Publication Data

US 2015/0000203 A1 Jan. 1, 2015

Related U.S. Application Data

(60) Provisional application No. 61/840,612, filed on Jun. 28, 2013.

(51) Int. Cl.

| | |
|---|---|
| ***B24D 3/00*** | (2006.01) |
| ***B24D 3/28*** | (2006.01) |
| ***B24D 3/06*** | (2006.01) |

(52) U.S. Cl.

CPC *B24D 3/28* (2013.01); *B24D 3/06* (2013.01)

(58) Field of Classification Search

CPC ... B24D 3/02; B24D 3/06; B24D 3/20; B24D 3/28; B24D 3/34; B24D 3/342; B24D 3/344; B24D 3/346; B24D 11/001; C09K 3/14; B24B 37/24

See application file for complete search history.

(56) References Cited

U.S. PATENT DOCUMENTS

| | | | | |
|---|---|---|---|---|
| 4,362,535 | A | 12/1982 | Isobe et al. | |
| 4,430,440 | A | 2/1984 | Wada et al. | |
| 5,316,559 | A | 5/1994 | Klievoneit et al. | |
| 5,832,360 | A * | 11/1998 | Andrews | B23K 35/302 228/122.1 |
| 6,187,069 | B1 | 2/2001 | Hoshi et al. | |
| 6,319,108 | B1 | 11/2001 | Adefris et al. | |
| 2009/0151267 | A1 | 6/2009 | Upadhyay et al. | |

(Continued)

FOREIGN PATENT DOCUMENTS

| | | | |
|---|---|---|---|
| CN | 1359322 | A | 7/2002 |
| EP | 1378323 | B1 | 8/2011 |

OTHER PUBLICATIONS

International Search Report for PCT/US2014/044475 dated Oct. 27, 2014, 3 pgs.

*Primary Examiner* — Matthew E Hoban
*Assistant Examiner* — Alexandra M Moore
(74) *Attorney, Agent, or Firm* — Abel Law Group, LLP; Joseph P. Sullivan

(57) ABSTRACT

An abrasive article includes abrasive particles contained within a hybrid bond that may include a metal bond material and an organic bond material, the article having an average thickness of 250 microns or less and the metal bond material including a solid solution phase and an intermetallic phase distinct from the solid solution phase.

15 Claims, 2 Drawing Sheets

(56) References Cited

U.S. PATENT DOCUMENTS

| | | | |
|---|---|---|---|
| 2011/0308371 | A1 | 12/2011 | Morita et al. |
| 2012/0216787 | A1 | 8/2012 | Morita et al. |
| 2013/0000211 | A1 | 1/2013 | Upadhyay et al. |

* cited by examiner

ABRASIVE ARTICLE WITH HYBRID BOND

CROSS-REFERENCE TO RELATED APPLICATION

This application claims priority under 35 U.S.C. §119(e) to U.S. Provisional App. No. 61/840,612, entitled "MULTIFUNCTION ABRASIVE ARTICLE WITH HYBRID BOND", by Cong Wang, et al., filed Jun. 28, 2013, which is assigned to the current assignee hereof and incorporated herein by reference in its entirety.

BACKGROUND

Field of the Disclosure

The following is directed to bonded abrasive articles, and more particularly, bonded abrasive articles including abrasive particles contained within a hybrid bond material including an organic bond material and a metal bond material.

Description of the Related Art

Abrasives used in machining applications typically include bonded abrasive articles and coated abrasive articles. Coated abrasive articles are generally layered articles having a backing and an adhesive coat to fix abrasive particles to the backing, the most common example of which is sandpaper. Bonded abrasive articles consist of rigid, and typically monolithic, three-dimensional, abrasive composites in the form of wheels, discs, segments, mounted points, hones and other article shapes, which can be mounted onto a machining apparatus, such as a grinding, polishing or cutting apparatus.

Bonded abrasive articles usually have at least two phases including abrasive particles and bond material. Certain bonded abrasive articles can have an additional phase in the form of porosity. The bond material can be a hybrid bond material that may include organic bond material and metal bond material. Bonded abrasive articles can be manufactured in a variety of 'grades' and 'structures' that have been defined according to practice in the art by the relative hardness and density of the abrasive composite (grade) and by the volume percentage of abrasive grain, bond, and porosity within the composite (structure).

Some bonded abrasive articles may be particularly useful in grinding, shaping or cutting certain types of workpieces, including for example, metals, ceramics and crystalline materials, used in the electronics and optics industries. In other instances, certain bonded abrasive articles may be used in grinding, shaping or cutting superabrasive materials for use in industrial applications. Unfortunately, bonded abrasive articles tend to wear and lose shape quickly during grinding, shaping and cutting of workpieces.

Accordingly, the industry continues to demand improved bonded abrasive articles and methods for their use.

SUMMARY

According to a first aspect, an abrasive article may include abrasive particles contained within a hybrid bond that may include a metal bond material and an organic bond material. The article may have an average thickness of 250 microns or less. The metal bond material may include a solid solution phase and an intermetallic phase. The intermetallic phase may be distinct from the solid solution phase.

According to another aspect, an abrasive article may include abrasive particles contained within a hybrid bond that may include a metal bond material and an organic bond material. The article may have an average thickness of 250 microns or less. The metal bond material may include a solid solution phase and an intermetallic phase. The intermetallic phase may include silver and may be distinct from the solid solution phase.

In yet another aspect, an abrasive article may include abrasive particles contained within a hybrid bond that may include a metal bond material and an organic bond material. The article may have an average thickness of 250 microns or less. The metal bond material may include a solid solution phase and an intermetallic phase. The intermetallic phase may include silver and tin and may be distinct from the solid solution phase.

According to still another aspect, an abrasive article may include abrasive particles contained within a hybrid bond that may include a metal bond material and an organic bond material. The article may have an average thickness of 250 microns or less. The metal bond material may include a solid solution phase and an intermetallic phase distinct from the solid solution phase. The solid solution phase may include silver, tin and copper.

According to still another aspect, an abrasive article may include abrasive particles contained within a hybrid bond that may include a metal bond material and an organic bond material. The article may have an average thickness of 250 microns or less. The metal bond material may include a solid solution phase having a fracture toughness of at least 3 $MPa \cdot m.^{0.5}$ and not greater than about 8 $MPa \cdot m.^{0.5}$ and an intermetallic phase distinct from the solid solution phase having a fracture toughness of at least 3 $MPa \cdot m.^{0.5}$ and not greater than about 5 $MPa \cdot m.^{0.5}$.

In yet a further aspect, an abrasive article may include abrasive particles contained within a hybrid bond that may include a metal bond material and an organic bond material. The article may have an average thickness of 250 microns or less. The metal bond material may include a solid solution phase having an average Vickers hardness of at least 1 GPa and not greater than about 5 GPa and an intermetallic phase distinct from the solid solution phase having an average Vickers hardness of at least 2 GPa and not greater than about 4 GPa.

According to still another aspect, an abrasive article may include abrasive particles contained within a hybrid bond that may include a metal bond material and an organic bond material. The article may have an average thickness of 250 microns or less. The metal bond material may include at least about 1 vol. % and not greater than about 100 vol. % of a solid solution phase that includes silver, tin and cooper for a total volume of the metal bond material of the hybrid bond.

In yet another aspect, an abrasive article may include abrasive particles contained within a hybrid bond that may include a metal bond material and an organic bond material. The article may have an average thickness of 250 microns or less. The metal bond material may include at least about 1 vol. % and not greater than about 100 vol. % of an intermetallic phase that includes silver, for a total volume of the metal bond material of the hybrid bond.

According to another aspect, an abrasive article may include a hybrid bond that may include a metal bond material and an organic bond material and abrasive particles contained within the hybrid bond. The article may have an average thickness of 250 microns or less. The metal bond material may include a combination of solid solution phase and intermetallic phase distinct from the solid solution phase and the metal bond material may be formed by combining silver and pre-alloyed bronze.

In still another aspect, a method for making an abrasive article may include providing a mixture that may include abrasive particles, an organic bond material, pre-alloyed bronze and silver and forming the mixture into a multifunction article that may include abrasive particles contained within a hybrid bond that may include a metal bond material and an organic bond material. The article may have an average thickness of 250 microns or less. The metal bond material may include a solid solution phase and an intermetallic phase. The intermetallic phase may be distinct from the solid solution phase.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1A:
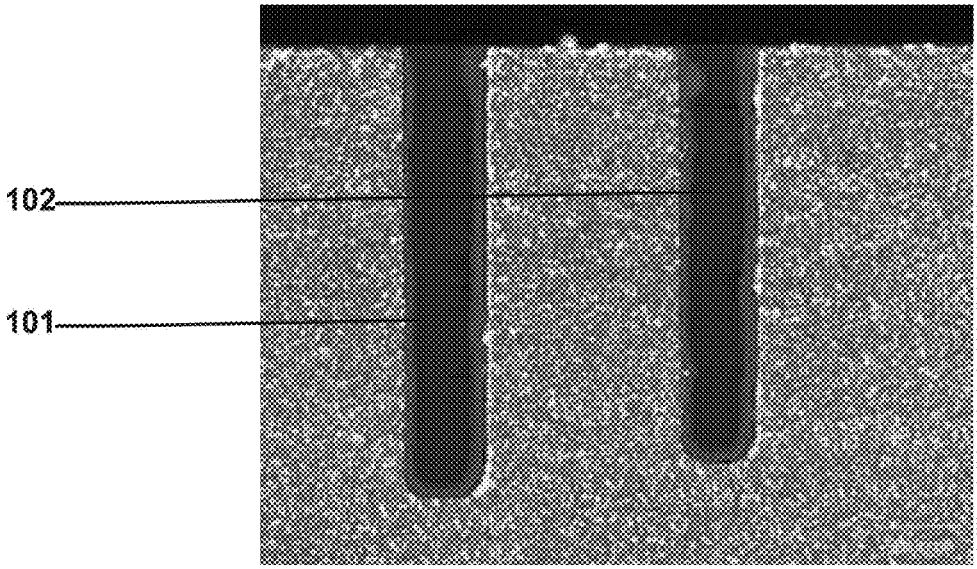
FIG. 1A includes an image of cuts made by an embodiment of an abrasive article in a workpiece during a tool wear test.

Abrasive articles and techniques are disclosed that can cut hard, brittle materials to relatively precise dimensions. The articles, which may include abrasive grits within a hybrid bond material of a metal bond material and a resin bond material (e.g., polyimide), may be employed, for example, in mirror finish cutting applications, thereby enabling "1×" or "single-pass" multi-function abrasive processes. Numerous article types and applications will be apparent in light of this disclosure, including, for example, abrasive articles for electronic device manufacturing, such as, thin 1A8 blades (single blade or multi-blade configuration) and other such cutting blades.

In one exemplary application, the disclosed abrasive articles may be used in the mirror finish dicing of read-write head sliders. Typically, read-write head sliders made of hard, brittle materials such as alumina titanium carbide (Al2O3-TiC) are manufactured in a two-step process involving a dicing step that uses a metal-bonded article and a subsequent discrete polishing step that uses a resin-bonded article. A article configured in accordance with embodiments herein may be capable of performing both slicing and polishing in a single pass (also referred to as a "1×" process herein). It will also be appreciated that, in light of this disclosure, embodiments described herein may also be used in multiple-pass or "2×" processes, if so desired.

In more detail, embodiments of abrasive articles described herein may include a hybrid bond and abrasive particles within the hybrid bond for dicing/polishing of hard and brittle material such as alumina-titanium carbide. The hybrid bond material may include an organic bond material and a metal bond material. The organic bond material and the metal bond material may each be substantially continuous or discrete in nature, although being substantially continuous in nature may have certain performance benefits associated with kerf quality and article wear. Further, the organic bond material and the metal bond material may be sintered in solid or liquid phase at process temperatures of the organic bond material. It will be appreciated that the metal bond material may transfer stiffness to the article (i.e., no interfacial sliding between metal and organic material), and the metal bond material may have a hardness less than that of the work material.

A process for forming an abrasive article according to embodiments described herein may be initiated by forming a mixture containing abrasive particles and unprocessed hybrid bond material. The unprocessed hybrid bond material may include an organic bond material and a metal bond material. The unprocessed metal bond material may include silver and pre-alloyed bronze.

In one particular embodiment, the pre-alloyed bronze may have a particular ratio of the content of Sn in the bronze ($C_{sn}$) to the content of Cu in the bronze ($C_{cu}$). The ratio may be expressed mathematically as $C_s/C_{cu}$. $C_{sn}$, represents the content of Sn in the bronze measured as a wt. % of the total weight of the bronze. $C_{cu}$ represents the content of Cu in the bronze measured as a wt. % of the total weight of the bronze. In one instance, the bronze alloy may have a $C_{sn}/C_{cu}$ ratio of not greater than about 2.0, not greater than about 1.8, not greater than about 1.6, not greater than about 1.4, not greater than about 1.2, not greater than about 1.0, not greater than about 0.8, not greater than about 0.7, not greater than about 0.65, not greater than about 0.64, not greater than about 0.63, not greater than about 0.62, not greater than about 0.61, not greater than about 0.60, not greater than about 0.59, not greater than about 0.58, not greater than about 0.57, not greater than about 0.56, not greater than about 0.55, not greater than about 0.54, not greater than about 0.53, not greater than about 0.52, not greater than about 0.51, not greater than about 0.50, not greater than about 0.49, not greater than about 0.48, not greater than about 0.47, not greater than about 0.46, not greater than about 0.45, not greater than about 0.44, not greater than about 0.43, not greater than about 0.42, not greater than about 0.41, not greater than about 0.40, not greater than about 0.39, not greater than about 0.38, not greater than about 0.37, not greater than about 0.36, not greater than about 0.35, not greater than about 0.34, not greater than about 0.33, not greater than about 0.32, not greater than about 0.31, not greater than about 0.30, not greater than about 0.28, not greater than about 0.26, not greater than about 0.24, not greater than about 0.22, not greater than about 0.20, not greater than about 0.15 or even not greater than about 0.12. In another instance, the bronze alloy may have a $C_{sn}/C_{cu}$ ratio of at least about 0.10, at least about 0.15, at least about 0.20, at least about 0.22, at least about 0.24, at least about 0.26, at least about 0.28, at least about 0.30, at least about 0.31, at least about 0.32, at least about 0.33, at least about 0.34, at least about 0.35, at least about 0.36, at least about 0.37, at least about 0.38, at least about 0.39, at least about 0.40, at least about 0.41, at least about 0.42, at least about 0.43, at least about 0.44, at least about 0.45, at least about 0.46, at least about 0.47, at least about 0.48, at least about 0.49, at least about 0.50, at least about 0.51, at least about 0.52, at least about 0.53, at least about 0.54, at least about 0.55, at least about 0.56, at least about 0.57, at least about 0.58, at least about 0.59, at least about 0.60, at least about 0.65, at least about 0.70, at least about 0.80 or even at least about 1.0. It will be appreciated that in particular instances, the bronze alloy may have a $C_{sn}/C_{cu}$ ratio within a range between any of the minimum and maximum values described above. In one particular embodiment, the pre-alloyed bronze may be, for example, 60/40 to 40/60 copper/tin by weight (e.g., 50/50 by weight %).

According to another particular embodiment, the metal alloy of copper and tin may include a certain content of copper, such that the finally-formed bonded abrasive article has suitable mechanical characteristics and grinding performance. For example, the copper and tin metal alloy may include at least about 60 wt. % copper, at least about 65 wt. % copper, at least about 70 wt. % copper, at least about 75 wt. % copper, at least about 80 wt. % copper, at least about 85 wt. % copper, at least about 90 wt. % copper or even at least about 95 wt. % copper for the total weight of the metal alloy. In another embodiment, the copper and tin metal alloy may include not greater than about 99 wt. % copper, not greater than about 95 wt. % copper, not greater than about 90 wt. % copper, not greater than about 85 wt. % copper, not greater than about 80 wt. % copper, not greater than about 75 wt. % copper, not greater than about 70 wt. % copper or even not greater than about 65 wt. % for the total weight of the metal alloy. It will be appreciated that amount of copper in the copper tin metal alloy may be within a range of any of the minimum and maximum values described herein. In particular instances, the amount of copper is within a range between about 60 wt. % and about 95 wt. %, and more particularly, between about 70 wt. % and about 85 wt. % for the total weight of the metal alloy.

According to another embodiment, certain metal alloys of copper and tin may have a certain content of tin to facilitate formation of an abrasive article according to an embodiment. For example, the metal alloy may include at least about 5 wt. % tin of the total weight of the composition. In other instances, the content of tin may be greater, such as, at least about 10 wt. %, at least about 15 wt. %, at least about 20 wt. %, at least about 25 wt. %, at least about 30 wt. %, at least about 35 wt. % or even at least about 40 wt. % for the total weight of the metal alloy. In other embodiments, the amount of tin may be not greater than about 45 wt. %, not greater than about 40 wt. %, not greater than about 35 wt. %, not greater than about 30 wt. %, not greater than about 25 wt. %, not greater than about 20 wt. %, not greater than about 15 wt. % or even not greater than about 10 wt. %. It will be appreciated that the content of tin in the metal alloy of copper and tin may be within a range of any of the minimum and maximum values described herein. In particular, certain bond materials may include a copper and tin metal alloy having a content of tin within a range between about 5 wt. % and about 40 wt. %, between about 10 wt. % and about 35 wt. %, or even between about 20 wt. % and about 25 wt. %.

The unprocessed hybrid bond material may be in the form of a hybrid bond powder. The unprocessed metal bond particles and organic bond particles in the hybrid bond powder may have an average diameter, for instance, of not more than 40 microns and more preferably 30 microns or less. The actual composition may vary depending on factors such as desired straightness and rigidity/ductility.

The abrasive particle are not intended to be limited to diamond, and can be essentially any suitable abrasive such as, oxides, carbides, nitrides, oxycarbides, oxynitrides, natural minerals or a combination thereof. In certain, non-limiting embodiments, the abrasive may be CBN, fused alumina, sintered alumina, silicon carbide, or mixtures thereof. The selection of abrasive depends on factors such as the material being cut and desired article cost. The abrasive grains may be provided with a coating, which will vary in its nature, depending on the specific abrasive used. For instance, if the abrasive is diamond or CBN then a metal coating on the abrasive (e.g. nickel) can be used to improve grinding properties. Similarly, fused alumina's grinding quality is enhanced, in certain grinding or cutting applications, if the grain is coated with iron oxide or a silane such as gamma amino propyl triethoxy silane. Likewise, sintered sol gel and seeded sol gel alumina abrasive exhibit enhanced grinding properties when they have been supplied with a silica coating, or in some cases, improvement may result if the sintered abrasive is silane treated. The operable abrasive grit size can also vary depending on the desired performance, and in accordance with some embodiments of the present disclosure, the grit size is 40 microns or finer.

In further reference to the abrasive particles, the morphology of the abrasive particles may be described by an aspect ratio, which is a ratio between the dimensions of length to width. It will be appreciated that the length is the longest dimension of the abrasive particle and the width is the second longest dimension of a given abrasive particle. In accordance with embodiments herein, the abrasive particles may have an aspect ratio (length:width) of not greater than about 2:1 or even not greater than about 1.5:1. In particular instances, the abrasive particles may be essentially equiaxed, such that they have an aspect ratio of approximately 1:1.

The mixture containing the abrasive particles and unprocessed hybrid bond material may be formed into any desired three-dimensional shape of any desired size, for example, the mixture may be formed into wheels, discs, segments, mounted points, hones and other article shapes, which may be mounted onto a machining apparatus, such as a grinding or polishing apparatus. Although the article type and its dimensions may vary (depending on the target application), one such example article is a type 1A8 wheel, having a thickness of about 30 to 130 microns (e.g., 65 microns or less), an outside diameter of about 50 to 150 millimeters (e.g., 110 mm), and inside diameter of about 35 to 135 mm (e.g., 90 mm). According to another non-limiting embodiment, the article may be a cutting article. In still other non-limiting embodiments, the article may be a wafer dicing article. In other instances, the article may be an abrasive wheel selected from the group of abrasive wheel types consisting of type 1, type 41, type 1A8, type 1A1, type 1A1R, type 1B1, type 1E1, type 1EE1, type 1F1, type 1FF1, type 1V1, type 1V1P or a combination thereof.

According to certain non-limiting embodiments, the abrasive article may have a substantially uniform thickness. In certain non-limiting embodiments, thickness of the article may be not greater than about 250 microns, such as, not greater than about 150 microns, not greater than about 100 microns, not greater than about 90 microns, not greater than about 70 microns or even not greater than about 65 microns. In still other embodiments, the article may have a thickness of at least about 1 micron, such as, at least about 10 microns, at least about 20 microns, at least about 30 microns, at least about 40 microns, at least about 50 microns or even, at least about 60 microns. It will be appreciated that the article may have a thickness of any value within a range between any of the minimum and maximum values noted above.

According to another embodiment, that abrasive article may include a first major surface, a second major surface, and a side surface extending between the first major surface and the second major surface. The side surface may define a dimension of thickness between the first major surface and second major surface. The article may have an aspect ratio (D/t) of at least about 10. D may represents a diameter of the article and t may represent the average thickness of the article. In certain embodiments, the aspect ratio (D/t) may be at least about 20, such as, at least about 50 or even at least about 100.

Forming the mixture into the desired shape of the finally-formed bonded abrasive article may include filling a steel mold with the mixture of abrasive particles and unprocessed hybrid bond material.

After filling the steel mold, the mixture may be heated at a temperature within a range of at least about 375° C. and not greater than about 450° C. In other embodiments, the mixture may be heated while being maintained at a specific pressure. For example, the mixture may be heated while being maintained at a pressure of at least about 1 ton per square inch and not greater than about 10 tons per square inch.

After completing the treating process, a bonded abrasive article incorporating abrasive particles within a hybrid metal bond material is formed. In accordance with embodiment described herein, the abrasive article may have a body having particular features.

Referring in particular to abrasive particles, according to certain embodiments, the abrasive article may include a content of abrasive particles of at least about 5 vol. % for a total volume of the abrasive article, such as, at least about 10 vol. %, at least about 15 vol. %, at least about 20 vol. %, at least about 25 vol. %, at least about 30 vol. % or even at least about 35 vol. % for the total volume of the abrasive article. In still other non-limiting embodiments, the abrasive article may include a content of abrasive particles of not greater than about 50 vol. % for the total volume of the abrasive article, such as, not greater than about 45 vol. %, not greater than about 40 vol. %, not greater than about 35 vol. %, not greater than about 30 vol. % or even not greater than about 25 vol. % for the total volume of the abrasive article. It will be appreciated that the content of abrasive particles in the abrasive article may be any value within a range between any of the minimum and maximum values noted above.

According to another embodiment, the abrasive particles may include a material selected from the group consisting of an oxide, a carbide, a nitride, a boride, an oxycarbide, an oxynitride, an oxyboride, diamond, a carbon-based material, and a combination thereof. The abrasive particles may include agglomerated particles. In still other instances, the abrasive particles may consist essentially of diamond or diamond grit particles. The diamond or diamond grit particles may have an average diameter, for instance, of not greater than about 40 microns, preferably in the range of 1 micron to 12 microns, and more preferably in the range of 1 micron to 3 microns.

Referring in particular to the organic bond material included in the hybrid bond material, according to certain embodiments, the organic bond material may be a resin bond material, such as, for example or a polyimide resin. A suitable polyimide (or other comparable resin) generally has low elongation % and high thermal stability. In still another embodiment, the organic bond material may include Vespel® SP1 polyimide or Mel din 7001 ® polyimide. According to yet another particular embodiment, the organic bond material may consist essentially of particles having an average diameter (D50) of not greater than about 40 microns.

In certain embodiments, the hybrid bond may include a content of organic bond material of at least about 1 vol. % for a total volume of the hybrid bond, such as, at least about 5 vol. %, at least about 10 vol. %, at least about 15 vol. %, at least about 20 vol. %, at least about 25 vol. %, at least about 30 vol. % and not greater than about 55 vol. % for the total volume of the hybrid bond. In another non-limiting embodiment, the hybrid bond material may include a content of organic bond material of not greater than about 50 vol. % for the total volume of the hybrid bond, such as, not greater than about 45 vol. %, not greater than about 40 vol. %, not greater than about 35 vol. % or even not greater than about 30 vol. % for the total volume of the hybrid bond. It will be appreciated that the content of organic bond material in the hybrid bond may be any value within a range between any of the minimum and maximum values noted above.

Referring in particular to the metal bond material included in the hybrid bond material, in certain embodiments, the metal bond material may include multiple metal phase materials, such as solid solution phases and intermetallic phases. Solid solution phases are defined as a combination of two or more metallic elements or alloys in a homogenous mixture having no fixed lattice structure and no ordered stoichiometry. Intermetallic phases are defined as a compound of two or more metallic elements having a set lattice or crystalline structure that differs from that of the elemental constituents and an ordered stoichiometry between the elemental constituents. In particular embodiments, the metal bond material may include at least one solid solution phase and at least one intermetallic phase distinct from the at least one solid solution phase.

According to other embodiments, the intermetallic phase distinct from the solid solution phase may include silver. In other embodiments, the intermetallic phase distinct from the solid solution phase may further include tin. In certain other embodiments, the intermetallic phase distinct from the solid solution may include $Ag_3Sn$.

According to other embodiments, the solid solution phase may include silver, tin and copper. According to another non-limiting embodiment, the solid solution phase may include a content of silver between about 15 wt. % and about 35 wt. % for the total weight of the solid solution phase, a content of copper between about 30 wt. % and about 50 wt. % for the total weight of the solid solution phase and a content of tin between about 25 wt. % and about 45 wt. % for the total weight of the solid solution phase. According to still another non-limiting embodiment, the solid solution phase may include a content of silver between about 5 wt. % to about 25 wt. % for the total weight of the solid solution phase, a content of copper between about 40 wt. % and about 60 wt. % for the total weight of the solid solution phase and a content of tin between about 25 wt. % and about 45 wt. % for the total weight of the solid solution phase. It will be appreciated that the content of silver, copper and tin included in the solid solution phase may also be express as a ratio ($C_{Ag}$:$C_{Cu}$:$C_{Sn}$) based on the ranges of wt. % noted above. For example, the solid solution phase may include a ratio $C_{Ag}$:$C_{Cu}$:$C_{Sn}$ of about 25:40:35.

In other embodiments, the solid solution phase may include an intermetallic phase. In certain embodiments, the intermetallic phase that is part of the solid solution phase may include silver. In still other embodiments, the intermetallic phase that is part of the solid solution phase may include tin. In yet other embodiments, the intermetallic phase that is part of the solid solution phase may include $Ag_3Sn$.

According to certain embodiments, the solid solution phase may have a fracture toughness (Klc) of at least about 3 MPa·m.$^{0.5}$, such as, at least about 3.5 MPa·m.$^{0.5}$, at least about 4.0 MPa·m.$^{0.5}$, at least about 4.5 MPa·m.$^{0.5}$, at least about 5.0 MPa·m.$^{0.5}$, at least about 5.5 MPa·m.$^{0.5}$, at least about 5.5 MPa·m.$^{0.5}$, at least about 6.0 MPa·m.$^{0.5}$, at least about 6.5 MPa·m.$^{0.5}$, at least about 7.0 MPa·m.$^{0.5}$, at least about 7.5 MPa·m.$^{0.5}$ or even at least about 7.9 MPa·m.$^{0.5}$. In other embodiments, the solid solution may have a fracture toughness of not greater than about 8.0 MPa·m.$^{0.5}$, such as, not greater than about 7.5 MPa·m.$^{0.5}$, not greater than about 7.0 MPa·m.$^{0.5}$, not greater than about 6.5 MPa·m.$^{0.5}$, not greater than about 6.0 MPa·m.$^{0.5}$, not greater than about 5.5 MPa·m.$^{0.5}$, not greater than about 5.0 MPa·m.$^{0.5}$, not greater than about 4.5 MPa·m.$^{0.5}$, not greater than about 4.0 MPa·m.$^{0.5}$ or even not greater than about 3.5 MPa·m.$^{0.5}$. It will be appreciated that the fracture toughness of the solid solution phase in the metal bond may be any value within a range between any of the maximum and minimum values noted above.

According to another particular embodiment, the intermetallic phase distinct from the solid solution or part of the solid solution may have a fracture toughness (Klc) of at least about 3 MPa·m.$^{0.5}$ such as, at least about 3.5 MPa·m.$^{0.5}$, at least about 4.0 MPa·m.$^{0.5}$, at least about 4.5 MPa·m.$^{0.5}$ or even at least about 5.0 MPa·m.$^{0.5}$. In other embodiments, the intermetallic phase may have a fracture toughness of not greater than about 5.0 MPa·m.$^{0.5}$, such as, not greater than about 4.5 MPa·m.$^{0.5}$, not greater than about 4.0 MPa·m.$^{0.5}$ or even not greater than about 3.5 MPa·m.$^{0.5}$. It will be appreciated that the fracture toughness of the intermetallic phase in the metal bond may be any value within a range between any of the maximum and minimum values noted above.

In certain embodiments, the fracture toughness of the intermetallic phase may be less than the fracture toughness of the solid solution phase. In other embodiments, the fracture toughness of the intermetallic phase may be at least about 5% of the fracture toughness of the solid solution phase, such as, at least about 10%, at least about 20%, at least about 30%, at least about 40%, at least about 50%, at least about 60%, at least about 70%, a least about 80% and at least about 90% of the fracture toughness of the solid solution phase. In other embodiments, the fracture toughness of the intermetallic phase may be not greater than about 95% of the fracture toughness of the soli solution phase, such as, not greater than about 90%, not greater than about 80%, not greater than about 70%, not greater than about 60%, not greater than about 50%, not greater than about 40%, not greater than about 30%, not greater than about 20%, not greater than about 10% of the fracture toughness of the solid solution phase. It will be appreciated that the fracture toughness of the intermetallic phase may be any percent of the fracture toughness of the solid solution phase between any of the minimum and maximum values noted above.

In certain embodiments, the solid solution phase may have a Vickers hardness of at least about 1 GPa, such as, at least about 1.5 GPa, at least about 2 GPa, at least about 2.5 GPa, at least about 3 GPa, at least about 3.5 GPa, at least about 4 GPa, at least about 4.5 GPa or even at least about 4.9 GPa. In other embodiments, the solid solution may have a Vickers hardness of not greater than about 5 GPa, such as, not greater than about 4.5 GPa, not greater than about 4.0 GPa, not greater than about 3.5 GPa, not greater than about 3.0 GPa, not greater than about 2.5 GPa, not greater than about 2.0 GPa or even not greater than about 1.5 GPa. It will be appreciated that the Vickers hardness of the solid solution phase in the metal bond may be any value within a range between any of the maximum and minimum values noted above.

According to another particular embodiment, the intermetallic phase distinct from the solid solution or part of the solid solution may have a Vickers hardness of at least about 2 GPa, such as, at least about 2.5 GPa, at least about 3 GPa, at least about 3.5 GPa, at least about 4 GPa, at least about 4.5 GPa or even at least about 4.9 GPa. In other embodiments, the intermetallic phase may have a Vickers hardness of not greater than about 4.0 GPa, such as, not greater than about 3.5 GPa, not greater than about 3.0 GPa, not greater than about 2.5 GPa or even not greater than about 2.0 GPa. It will be appreciated that the Vickers hardness of the intermetallic phase in the metal bond may be any value within a range between any of the maximum and minimum values noted above.

In other embodiments, the Vickers hardness of the intermetallic phase may be greater than the Vickers hardness of the solid solution phase. In other embodiments, the Vickers hardness of the intermetallic phase may be at least about 5% greater than the fracture toughness of the solid solution phase, such as, at least about 10% greater than, at least about 20% greater than, at least about 30% greater than, at least about 40% greater than, at least about 50% greater than, at least about 60% greater than, at least about 70% greater than, at least about 80% greater than and at least about 90% greater than the Vickers hardness of the solid solution phase. In other embodiments, the Vickers hardness of the intermetallic phase may be not greater than about 95% greater than the Vickers hardness of the solid solution phase, such as, not greater than about 90% greater than, not greater than about 80% greater than, not greater than about 70% greater than, not greater than about 60% greater than, not greater than about 50% greater than, not greater than about 40% greater than, not greater than about 30% greater than, not greater than about 20% greater than, not greater than about 10% greater than the Vickers hardness of the solid solution phase. It will be appreciated that the Vickers hardness of the intermetallic phase may be any percent greater than the Vickers hardness of the solid solution phase between any of the minimum and maximum values noted above.

In certain embodiments, the metal bond material may include a specific content of solid solution phase. For example, the metal bond material may include at least about 1 vol. % solid solution phase for the total volume of the metal bond material, such as, at least about at least about 2 vol. %, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % or even at least about 99 vol. % for the total volume of the metal bond. In other non-limiting embodiments, the metal bond material may include not greater than about 100 vol. % solid solution phase for the total volume of the metal bone material, such as, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. % or even not greater than about 2 vol. % for the total volume of the metal bond material. It will be appreciated that the content of solid solution phase in the metal bond material may be any value within a range between any of the minimum and maximum values noted above.

In certain embodiments, the metal bond material may include a specific content of intermetallic phase distinct from any solid solution phase. For example, the metal bond material may include at least about 1 vol. % intermetallic phase for the total volume of the metal bond material, such as, at least about at least about 2 vol. %, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % or even at least about 99 vol. % for the total volume of the metal bond. In other non-limiting embodiments, the metal bond material may include not greater than about 100 vol. % intermetallic phase for the total volume of the metal bond material, such as, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. % or even not greater than about 2 vol. % for the total volume of the metal bond material. It will be appreciated that the content of intermetallic phase in the metal bond material may be any value within a range between any of the minimum and maximum values noted above.

According to yet another particular embodiment, the metal bond material may include elemental phase metallic material at a set content. Elemental phase metallic material may be defined a single metallic material in elemental form that is not part of a solid solution phase or intermetallic phase. In certain embodiments, the content of elemental phase metallic material in the metal bond material may be not greater than about 10 vol. % for a total volume of the metal bond material, such as, not greater than about 9 vol. %, not greater than about 8 vol. %, not greater than about 7 vol. %, not greater than about 6 vol. %, not greater than about 5 vol. %, not greater than about 4 vol. %, not greater than about 3 vol. %, not greater than about 2 vol. %, not greater than about 1 vol. %, not greater than about 0.5 vol. %, not greater than about 0.4 vol. %, not greater than about 0.3 vol. %, not greater than about 0.2 vol. % or even not greater than about 0.1 vol. % for the total volume of the metal bond material.

According to yet another embodiment, the metal bond material may include a ratio ($C_{SS}/C_{IM}$) of the content of solid solution phase ($C_{SS}$) in the metal bond material to the content of intermetallic phase ($C_{IM}$) in the metal bond material. The content of solid solution phase ($C_{SS}$) represents the content of solid solution in the metal bond in vol. % for the total volume of the metal bond and the content of intermetallic phase ($C_{IM}$) represents the content of intermetallic phase in the metal bond in vol. % for total volume of the metal bond. In certain embodiments, the ratio $C_{SS}/C_{IM}$ may be not greater than about 90, not greater than about 80, not greater than about 70, not greater than about 60, not greater than about 50, not greater than about 40, not greater than about 30, not greater than about 20, not greater than about 10, not greater than about 9, not greater than about 8, not greater than about 7, not greater than about 6, not greater than about 5, not greater than about 4, not greater than about 3, not greater than about 2, not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01, not greater than about 0.005 or even not greater than about 0.001. In another non-limiting embodiments, the ratio $C_{SS}/C_{IM}$ may be at least about 0.001, for example, at least about 0.005, at least about 0.01, at least about 0.05, at least about 0.1, at least about 0.2, at least about 0.3, at least about 0.4, at least about 0.5, at least about 0.6, at least about 0.7, at least about 0.8, at least about 0.9, at least about 1, at least about 2, at least about 3, at least about 4, at least about 5, at least about 10, at least about 20, at least about 30, at least about 40, at least about 50, at least about 60, at least about 70, at least about 80, at least about 90 or even at least about 99. It will be appreciated that the ratio $C_{SS}/C_{IM}$ may be any value within a range between any of the minimum and maximum values note above.

According to yet another embodiment, the metal bond material may include a ratio ($C_E/C_{IM}$) of the content of elemental phase ($C_E$) in the metal bond material to the content of intermetallic phase ($C_{IM}$) in the metal bond material. The content of elemental phase ($C_E$) is the content of elemental phase in the metal bond in vol. % for the total volume of the metal bond and the content of intermetallic phase ($C_{IM}$) represents the content of intermetallic phase in the metal bond in vol. % for total volume of the metal bond. In certain embodiments, the ratio $C_E/C_{IM}$ may be not greater than about 1, such as, not greater than about 0.9, not greater than about 0.8, not greater than about 0.7, not greater than about 0.6, not greater than about 0.05, not greater than about 0.4, not greater than about 0.3, not greater than about 0.2, not greater than about 0.1, not greater than about 0.09, not greater than about 0.08, not greater than about 0.07, not greater than about 0.06, not greater than about 0.05, not greater than about 0.04, not greater than about 0.03, not greater than about 0.02, not greater than about 0.01, not greater than about 0.005 or even not greater than about 0.001. In another non-limiting embodiment, the ratio $C_E/C_{SS}$ may be at least about 0.0001, such as, at least about 0.001, at least about 0.005, at least about 0.001, at least about 0.02, at least about 0.03, at least about 0.04, at least about 0.05, at least about 0.06, at least about 0.07, at least about 0.08, at least about 0.09, at least about 0.1, at least about 0.2, at least about 0.3, at least about 0.4, at least about 0.5, at least about 0.6, at least about 0.7, at least about 0.8 or even about 0.9. It will be appreciated that the ratio $C_E/C_{IM}$ may be any value within a range between any of the minimum and maximum values note above.

In still other embodiments, the metal bond material may include a content of binary compound of at least about 1 vol. % for the total volume of the metal bond material, such as, at least about 2 vol. %, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % or even at least about 99 vol. % for the total volume of the metal bond material. In still other non-limiting embodiments, the metal bond material may include a content of binary compound of not greater than about 100 vol. % for a total volume of the metal bond material, such as, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. % or even not greater than about 2 vol. % for the total volume of the metal bond material. It will be appreciated that the content of binary compound in the metal bond material may be any value within a range between any of the minimum and maximum values noted above.

In still other embodiments, the metal bond material may include a content of ternary compound of at least about 1 vol. % for the total volume of the metal bond material, such as, at least about 2 vol. %, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % or even at least about 99 vol. % for the total volume of the metal bond material. In still other non-limiting embodiments, the metal bond material may include a content of ternary compound of not greater than about 100 vol. % for a total volume of the metal bond material, such as, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. % or even not greater than about 2 vol. % for the total volume of the metal bond material. It will be appreciated that the content of ternary compound in the metal bond material may be any value within a range between any of the minimum and maximum values noted above.

According to yet another embodiment, the metal bond material may include a ratio ($C_{BC}/C_{TC}$) of the content of binary compound ($C_{BC}$) in the metal bond material to the content of ternary compound ($C_{TC}$) in the metal bond material. The content of binary compound ($C_{BC}$) is the content of binary compound in vol. % for the total volume of the metal bond and the content of ternary compound ($C_{TC}$) represents the content of ternary compound in the metal bond in vol. % for total volume of the metal bond. In certain embodiments, the ratio $C_{BC}/C_{TC}$ may be not greater than about 90, not greater than about 80, not greater than about 70, not greater than about 60, not greater than about 50, not greater than about 40, not greater than about 30, not greater than about 20, not greater than about 10, not greater than about 9, not greater than about 8, not greater than about 7, not greater than about 6, not greater than about 5, not greater than about 4, not greater than about 3, not greater than about 2, not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01, not greater than about 0.005 or even not greater than about 0.001. In another non-limiting embodiments, the ratio $C_{BC}/C_{TC}$ may be at least about 0.001, for example, at least about 0.005, at least about 0.01, at least about 0.05, at least about 0.1, at least about 0.2, at least about 0.3, at least about 0.4, at least about 0.5, at least about 0.6, at least about 0.7, at least about 0.8, at least about 0.9, at least about 1, at least about 2, at least about 3, at least about 4, at least about 5, at least about 10, at least about 20, at least about 30, at least about 40, at least about 50, at least about 60, at least about 70, at least about 80, at least about 90 or even at least about 99. It will be appreciated that the ratio $C_{BC}/C_{TC}$ may be any value within a range between any of the minimum and maximum values note above.

In still other non-limiting embodiments, the metal bond material may include a metal alloy. In still other non-limiting embodiments, the solid solution phase in the metal bond material may include a metal alloy. The metal alloy may be bronze. In certain instances, the bronze may include a content of tin of not greater than about 65 wt. % for a total weight of bronze, such as, not greater than about 60 wt. %, not greater than about 55 wt. %, not greater than about 50 wt. %, not greater than about 45 wt. % or even not greater than about 40 wt. %. In still further embodiments, the bronze may include a content of tin of at least about 10 wt. % for the total weight of the bronze, such as, at least about 20 wt. %, at least about 30 wt. % at least about 40 wt. %, at least about 50 wt. % or even at least about 60 wt. % tin for a total weight of bronze. It will be appreciated that the content of tin in the bronze may be any value within a range between any of the minimum and maximum values noted above. In certain other embodiments, the bronze may include, for example, 60/40 to 40/60 copper/tin by weight (e.g., 50/50 by weight %).

In still other instances, the bronze may include a content of copper of at least about 10 wt. % for a total weight of bronze, such as, at least about 20 wt. %, at least about 30 wt. %, at least about 40 wt. %, at least about 45 wt. %, at least about 50 wt. %, at least about 55 wt. %, at least about 60 wt. %, at least about 65 wt. %, at least about 70 wt. % or even at least about 75 wt. % copper for the total weigh of bronze. In still further embodiments, the bronze may include a content of copper of not greater than about 90 wt. % for a total weight of the bronze, such as, not greater than about 80 wt. %, not greater than about 70 wt. %, not greater than about 60 wt. %, not greater than about 55 wt. % or even not greater than about 50 wt. %.

According to another example embodiment, the bronze may include a content of copper that is not less than a content of tin. In still other embodiments, the bronze may include a content of copper that is greater than a content of tin.

According to another embodiment, hybrid bond material may include a greater content (vol. %) of the metal bond material compared to a content (vol. %) of the organic bond material. In still other embodiments, the hybrid bond material may include substantially the same content (vol. %) of metal bond material compared to a content (vol. %) of the organic bond material. In still other embodiments, the hybrid bond material may include at least about 20 vol. % metal bond material for a total volume of the hybrid bond material, such as, at least about 30 vol. %, at least about 40 vol. %, at least about 45 vol. %, at least about 50 vol. %, at least about 55 vol. % or even at least about 60 vol. % for the total volume of the hybrid bond material. In yet other non-limiting embodiments, the hybrid bond material may include not greater than about 90 vol. %, not greater than about 85 vol. %, not greater than about 80 vol. %, not greater than about 75 vol. %, not greater than about 70 vol. % or even not greater than about 65 vol. % for the total volume of the hybrid bond material. It will be appreciated that the content of metal bond in the hybrid bond material may be any value within a range between any of the minimum and maximum values noted above. Further, the metal bond material may be a continuous phase extending as an interconnected network of material throughout the volume of the article.

According to a particular embodiment, the abrasive article may include about 10-13 vol. % of polyimide for a total volume of the article, about 68-72 vol. % of metal bond material for a total volume of the article, and about 16-20 vol. % of abrasive particles for a total volume of the article.

According to another embodiment, the abrasive article may be one or a multi-blade assembly. The assembly may include a plurality of abrasive articles in a gang configuration.

In other embodiments, the abrasive article may include a content of porosity of not greater than about 10 vol. % for a total volume of the article.

According to yet another embodiment, a article configured in accordance with an embodiment of the present disclosure has shown a superior ability to withstand handling and high grinding forces by maintaining a suitable degree of ductility, and can be used to grind at higher depths of cut. According to certain aspects, abrasive articles according to embodiments described herein may have the ability to substantially maintain initial cut depth with a percentage of original cut depth (e.g., a cut-depth factor of at least about 90%, wherein cut depth factor is calculated by the equation $[D_{co}-Dc60)]/Dco]\times100\%$ wherein $D_{co}$ is the original depth of cut ((on an AlTiC substrate by the abrasive article under test conditions) and $D_{cn}$ is the depth of cut after 60 distinct cuts.

Examples

An abrasive article according to embodiments described herein was formed from a mixture of the components as provided in Table 1.

TABLE 1

| Example 1 | |
|---|---|
| Component | Content |
| DI 0.9 um Diamond | 1.96 gms × 10 = 19.60 gms |
| Fine Bronze | 11.25 gms × 10 = 112.50 gms |
| DA126 (Ag) | 2.82 gms × 10 = 28.20 gms |
| Meldin 7001 Resin | 1.11 gms × 10 = 11.10 gms |
| TWW | 17.14 gms × 10 = 171.40 gms |

The mixture was pressed into a steel mold and then heated at a temperature within a range of at least about 375° C. and not greater than about 450° C. The mixture was heated while being maintained at a pressure of at least about 1 ton per square inch and not greater than about 10 tons per square inch.

Figure 1B:
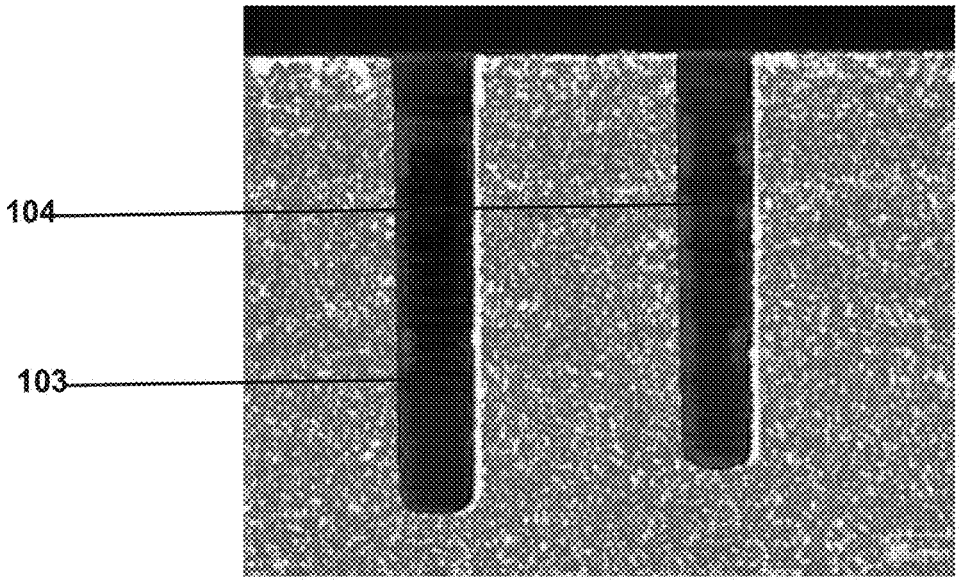
FIG. 1B includes an image of cuts made by an embodiment of an abrasive article in a workpiece during a tool wear test.

Samples of the abrasive article described in Example 1 were tested to determine tool wear. The test included slicing a 2"×2"×0.049" thick alumina-titanium carbide wafer into multiple slices. A precision slicing machine was used with a wheel rpm of 9000 and a traverse rate of 4"/min. FIG. 1A includes an image comparing the depth and kerf of a first sample (S1) of the abrasive article described in Example 1 after no cuts, shown as cut 101, and then after 61 cuts, shown as cut 102. FIG. 1B includes an image comparing the depth and kerf of a first sample (S1) of the abrasive article described in Example 1 after no cuts, shown as cut 103, and then after 61 cuts, shown as cut 104. For sample 1, the wheel incurred 0.027 mm of wheel wear after 61 cuts and the wheel kerf change from 0.073 mm at the initial cut to 0.068 mm on cut 61. For sample 2, the wheel incurred 0.035 mm wheel wear.

Figure 2A:
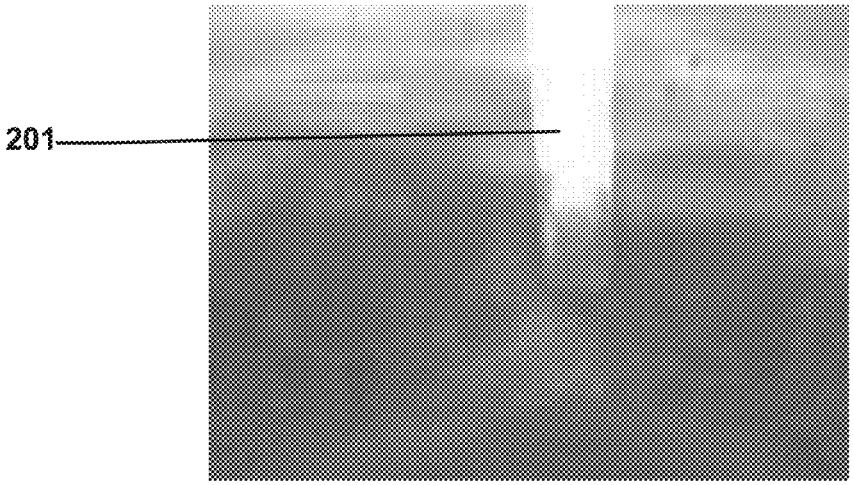
FIG. 2A includes an image of a cut made by a conventional abrasive article in a workpiece during a tool wear test.
Figure 2B:
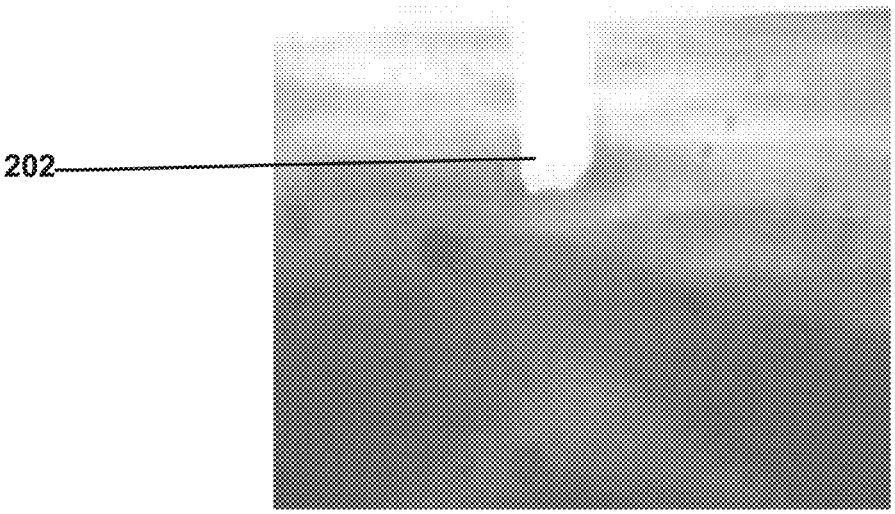
FIG. 2B includes an image of a cut made by a conventional abrasive article in a workpiece during a tool ware test.

A sample of a conventional abrasive (CS1) was also tested to determine tool wear. The test included slicing a 2"×2"×0.049" thick alumina-titanium carbide wafer into multiple slices. A precision slicing machine was used with a wheel rpm of 9000 and a traverse rate of 4"/min. FIG. 2A includes an image of an initial cut 201 made by the conventional sample (CS1) and FIG. 2B includes an image of cut 202 made by the conventional sample (CS1) after 61 cuts.

It should be noted that commercially available abrasive articles consist of cobalt metal, resin, and fine diamond grits. However, the use of cobalt can pose a number of issues. Specifically, a cobalt-based product is typically very brittle and tends to break in handling and use. In addition, use of cobalt leads to a structure that is under-sintered and possesses poor grit retention (this is because cobalt doesn't flow very well at process temperatures associated with suitable resins). Depending on context, cobalt can be environmentally unfriendly. Furthermore, the high stiffness of cobalt may not be transferred to the article due to sliding at the cobalt-resin interface. Other factors, such as the choice of resin type and fillers used, and process temperature also play a role in article performance (e.g., beneficial qualities of resin deteriorate when subjected to excessive temperature).

Another subtle but significant issue associated with using cobalt is related to magnetic properties. In particular, cobalt is known as a hard ferro-magnetic material which will readily magnetize. To this end, it is believed that the cobalt in a cobalt-based blade may upset the magnetic properties of the sliced and polished workpiece (e.g., Al2O3-TiC sliders). This could be due either to residual cobalt contamination picked up on the surface of the workpiece during cutting (e.g., as the article wears, cobalt is released from the article and some of it sticks to or is embedded in the workpiece), or to the effect of cobalt in the article influencing the local magnetic field around the grinding zone, which subsequently interacts with the workpiece.

More exacting applications calling for greater precision and cut quality have historically used different article configurations and bond types. For example, and as is known, a hard disk drive (HDD) is a commonly used storage mechanism used in numerous consumer electronic applications, including computers and game consoles, mobile phones and personal digital assistants, digital cameras and video recorders, and digital media players (e.g., MP3 players). HDD designs generally include a circular magnetic 'platter' (onto which data are recorded) that spins about a spindle. As the platter spins, a read-write head is used to detect and/or modify the magnetization of the platter storage location directly under it. The read-write head itself is attached to a 'slider,' which is an aerodynamically shaped block that allows the read-write head to maintain a consistent 'flying height' above the platter. The slider is connected to an actuator assembly (e.g., motor and arm) that operates to move the read-write head to any storage location on the platter. Manufacturing of the slider component presents a number of challenges. For instance, as the form factor of the electronic devices that employ HDDs decreases, so does the size of the components that make up the HDD, including the slider (which can be about 1/50th to 1/100th the size of a penny). As such, the slider must be cut to fairly precise dimensions. Exacerbating this manufacturing complexity is the fact that sliders are typically made from hard brittle materials (e.g., Al2O3-TiC, see for example U.S. Pat. No. 4,430,440), which are difficult to cut without incurring problems such as chipping and excessive kerf.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

Item 1. An abrasive article, comprising a hybrid bond comprising a metal bond material and an organic bond material, abrasive particles contained within the hybrid bond, wherein the article has an average thickness of 250 microns or less, and wherein the metal bond material comprises a solid solution phase, and an intermetallic phase distinct from the solid solution phase.

Item 2. An abrasive article, comprising a hybrid bond comprising a metal bond material and an organic bond material, abrasive particles contained within the hybrid bond, wherein the article has an average thickness of 250 microns or less, and wherein the metal bond material comprises a solid solution phase, and an intermetallic phase distinct from the solid solution phase comprising silver.

Item 3. An abrasive article, comprising a hybrid bond comprising a metal bond material and an organic bond material, abrasive particles contained within the hybrid bond wherein the article has an average thickness of 250 microns or less and wherein the metal bond material comprises a solid solution phase, and an intermetallic phase distinct from the solid solution phase comprising silver and tin.

Item 4. An abrasive article, comprising a hybrid bond comprising a metal bond material and an organic bond material, abrasive particles contained within the hybrid bond, wherein the article has an average thickness of 250 microns or less and wherein the metal bond material comprises a solid solution phase comprising silver, tin and copper, and an intermetallic phase distinct from the soli solution phase.

Item 5. An abrasive article, comprising a hybrid bond comprising a metal bond material and an organic bond material, abrasive particles contained within the hybrid bond wherein the article has an average thickness of 250 microns or less and wherein the metal bond material comprises: a solid solution phase having a fracture toughness of at least 3 MPa·m.0.5 and not greater than about 8 MPa·m.0.5, and an intermetallic phase distinct from the solid solution phase having a fracture toughness of at least 3 MPa·m.0.5 and not greater than about 5 MPa·m.0.5.

Item 6. An abrasive article, comprising a hybrid bond comprising a metal bond material and an organic bond material, abrasive particles contained within the hybrid bond wherein the article has an average thickness of 250 microns or less; and wherein the metal bond material comprises a solid solution phase having an average Vickers hardness of at least 1 GPa and not greater than about 5 GPa, and an intermetallic phase distinct from the solid solution phase having an average Vickers hardness of at least 2 GPa and not greater than about 4 GPa.

Item 7. An abrasive article, comprising a hybrid bond comprising a metal bond material and an organic bond material, abrasive particles contained within the hybrid bond wherein the article has an average thickness of 250 microns or less, and wherein the metal bond material comprises at least about 1 vol. % and not greater than about 100 vol. % of a solid solution phase comprising silver, tin and cooper for a total volume of the metal bond material of the hybrid bond.

Item 8. An abrasive article, comprising a hybrid bond comprising a metal bond material and an organic bond material, abrasive particles contained within the hybrid bond wherein the article has an average thickness of 250 microns or less, and wherein the metal bond material comprises at least about 1 vol. % and not greater than about 100 vol. % of a intermetallic phase comprising silver, for a total volume of the metal bond material of the hybrid bond.

Item 9. An abrasive article, comprising a hybrid bond comprising a metal bond material and an organic bond material and abrasive particles contained within the hybrid bond, wherein the article has an average thickness of 250 microns or less, and wherein the metal bond material comprises a combination of solid solution phase and intermetallic phase distinct from the solid solution phase formed by combining silver and pre-alloyed bronze.

Item 10. A method for making an abrasive article, the method comprising the steps of providing a mixture including abrasive particles, an organic bond material, pre-alloyed bronze and silver and forming the mixture into a multifunction article comprising a hybrid bond comprising a metal bond material and an organic bond material and abrasive particles contained within the hybrid bond wherein the article has an average thickness of 250 microns or less and wherein the metal bond material comprises a solid solution phase, and an intermetallic phase distinct from the solid solution phase.

Item 11. A method for making an abrasive article, the method comprising the steps of providing a mixture including abrasive particles, an organic bond material, pre-alloyed bronze and silver, forming a metal bond material in a hybrid bond material by integrating the silver into the pre-alloyed bronze wherein integrating the silver into the pre-alloyed bond material forms a solid solution phase and an intermetallic phase distinct from the solid solution phase.

Item 12. The abrasive article or method for making the abrasive article of any one of the previous items, wherein the intermetallic phase comprises silver.

Item 13. The abrasive article or method for making the abrasive article of any one of the previous items, wherein the intermetallic phase comprises silver and tin.

Item 14. The abrasive article or method for making the abrasive article of any one of the previous items, wherein the intermetallic phase comprises Ag3Sn.

Item 15. The abrasive article or method for making the abrasive article of any one of the previous items, wherein the solid solution phase comprises silver, tin and copper.

Item 16. The abrasive article or method for making the abrasive article of any one of the previous items, wherein the metal bond material comprises at least about 2 vol. % of the solid solution phase for a total volume of the metal bond material, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % and 99 vol. % for the total volume of the metal bond.

Item 17. The abrasive article or method for making the abrasive article of any one of the previous items, wherein the metal bond material comprises not greater than 100 vol. % of the solid solution phase for a total volume of the metal bond material, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. %, and not greater than about 2 vol. % for the total volume of the metal bond material.

Item 18. The abrasive article or method for making the abrasive article of any one of the previous items, wherein the metal bond material comprises at least about 2 vol. % of the intermatallic phase for a total volume of the metal bond material, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % and 99 vol. % for the total volume of the metal bond.

Item 19. The abrasive article or method for making the abrasive article of any one of the previous items, wherein the metal bond material comprises not greater than 100 vol. % of the intermatallic phase for a total volume of the metal bond material, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. %, and not greater than about 2 vol. % for the total volume of the metal bond material.

Item 20. The abrasive article or method for making the abrasive article of any one of the previous items, wherein the metal bond material comprises not greater than about 10 vol. % of an elemental phase for a total volume of the metal bond material, not greater than about 9 vol. %, not greater than about 8 vol. %, not greater than about 7 vol. %, not greater than about 6 vol. %, not greater than about 5 vol. %, not greater than about 4 vol. %, not greater than about 3 vol. %, not greater than about 2 vol. %, not greater than about 1 vol. %, not greater than about 0.5 vol. %, not greater than about 0.4 vol. %, not greater than about 0.3 vol. %, not greater than about 0.2 vol. %, and not greater than about 0.1 vol. % for the total volume of the metal bond material.

Item 21. The abrasive article or method for making the abrasive article of any one of the previous items, wherein the metal bond material comprises a ratio (CSS/CIM) of not greater than about 100, where CSS represents the content of solid solution phase in the metal bond in vol. % for the total volume of the metal bond and CIM represents the content of intermetallic phase in the metal bond in vol. % for total volume of the metal bond, not greater than about 90, not greater than about 80, not greater than about 70, not greater than about 60, not greater than about 50, not greater than about 40, not greater than about 30, not greater than about 20, not greater than about 10, not greater than about 9, not greater than about 8, not greater than about 7, not greater than about 6, not greater than about 5, not greater than about 4, not greater than about 3, not greater than about 2, not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01, not greater than about 0.005, and not greater than about 0.001.

Item 22. The abrasive article or method for making the abrasive article of any one of the previous items, wherein the metal bond material comprises a ratio (CSS/CIM) of at least about 0.001, where CSS represents the content of solid solution phase in the metal bond in vol. % for the total volume of the metal bond and CIM represents the content of intermetallic phase in the metal bond in vol. % for total volume of the metal bond, at least about 0.005, at least about 0.01, at least about 0.05, at least about 0.1, at least about 0.2, at least about 0.3, at least about 0.4, at least about 0.5, at least about 0.6, at least about 0.7, at least about 0.8, at least about 0.9, at least about 1, at least about 2, at least about 3, at least about 4, at least about 5, at least about 10, at least about 20, at least about 30, at least about 40, at least about 50, at least about 60, at least about 70, at least about 80, at least about 90, at least about 99.

Item 23. The abrasive article or method for making the abrasive article of any one of the previous items, wherein the metal bond material comprises a ratio (CE/CIM) of not greater than about 0.1, where CE represents the content of element phase in the metal bond in vol. % for the total volume of the metal bond and CIM represents the content of intermetallic phase in the metal bond in vol. % for total volume of the metal bond, not greater than about 0.9, not greater than about 0.8, not greater than about 0.7, not greater than about 0.6, not greater than about 0.05, not greater than about 0.4, not greater than about 0.3, not greater than about 0.2, not greater than about 0.1, not greater than about 0.09, not greater than about 0.08, not greater than about 0.07, not greater than about 0.06, not greater than about 0.05, not greater than about 0.04, not greater than about 0.03, not greater than about 0.02, not greater than about 0.01, not greater than about 0.005, and not greater than about 0.001.

Item 24. The abrasive article or method for making the abrasive article of any one of the previous items, wherein the metal bond material comprises a ratio (CE/CSS) of not greater than about 0.1, where CE represents the content of element phase in the metal bond in vol. % for the total volume of the metal bond and CSS represents the content of solid solution phase in the metal bond in vol. % for total volume of the metal bond, not greater than about 0.9, not greater than about 0.8, not greater than about 0.7, not greater than about 0.6, not greater than about 0.05, not greater than about 0.4, not greater than about 0.3, not greater than about 0.2, not greater than about 0.1, not greater than about 0.09, not greater than about 0.08, not greater than about 0.07, not greater than about 0.06, not greater than about 0.05, not greater than about 0.04, not greater than about 0.03, not greater than about 0.02, not greater than about 0.01, not greater than about 0.005, and not greater than about 0.001.

Item 25. The abrasive article or method for making the abrasive article of any one of the previous items, wherein the metal bond material comprises a solid solution phase having a fracture toughness of at least 3 MPa·m.0.5 and not greater than about 8 MPa·m.0.5.

Item 26. The abrasive article or method for making the abrasive article of any one of the previous items, wherein the metal bond material comprises an intermetallic phase distinct from the solid solution phase having a fracture toughness of at least 3 MPa·m.0.5 and not greater than about 5 MPa·m.0.5.

Item 27. The abrasive article or method for making the abrasive article of any one of the previous items, wherein the fracture toughness of the intermetallic phase in the metal bond is greater than the fracture toughness of the solid solution phase in the metal bond material.

Item 28. The abrasive article or method for making the abrasive article of any one of the previous items, wherein the metal bond material comprises an abrasive article, comprising a solid solution phase having an average Vickers hardness of at least 1 GPa and not greater than about 5 GPa.

Item 29. The abrasive article or method for making the abrasive article of any one of the previous items, wherein the metal bond material comprises an intermetallic phase distinct from the solid solution phase having an average Vickers hardness of at least 2 GPa and not greater than about 4 GPa.

Item 30. The abrasive article or method for making the abrasive article of any one of the previous items, wherein the average Vickers hardness of the solid solution phase in the metal bond material is greater than the average Vickers hardness of the intermetallic phase in the metal bond material.

Item 31. The abrasive article or method for making the abrasive article of any one of the previous items, wherein the metal bond material comprises bronze.

Item 32. The abrasive article or method for making the abrasive article of any one of the previous items, wherein the solid solution comprises bronze.

Item 33. The abrasive article or method for making the abrasive article of any one of the previous items, wherein the metal bond material comprises copper and tin.

Item 34. The abrasive article or method for making the abrasive article of any one of items 31 and 32, wherein the bronze comprises not greater than about 65 wt. % tin for a total weight of bronze, not greater than about 60 wt. %, not greater than about 55 wt. %, not greater than about 50 wt. %, not greater than about 45 wt. %, not greater than about 40 wt. %, and at least about 10 wt. %, at least about 20 wt. %, at least about 30 wt. % tin for a total weight of bronze.

Item 35. The abrasive article or method for making the abrasive article of any one of the previous items, wherein the bronze comprises a content of copper that is not less than a content of tin.

Item 36. The abrasive article or method for making the abrasive article of any one of the previous items, wherein the bronze comprises a content of copper that is greater than a content of tin.

Item 37. The abrasive article or method for making the abrasive article of any one of the previous items, wherein the bronze comprises at least about 10 wt. % copper for a total weight of bronze, at least about 20 wt. %, at least about 30 wt. %, at least about 40 wt. %, at least about 45 wt. %, at least about 50 wt. %, at least about 55 wt. %, at least about 60 wt. %, at least about 65 wt. %, at least about 70 wt. %, at least about 75 wt. %, and wherein the bronze comprises not greater than about about 90 wt. % copper for a total weight of the bronze, not greater than about 80 wt. %, not greater than about 70 wt. %, not greater than about 60 wt. %, not greater than about 55 wt. %, not greater than about 50 wt. %.

Item 38. The abrasive article or method for making the abrasive article of any one of the previous items, wherein the article is a cutting article.

Item 39. The abrasive article or method for making the abrasive article of any one of the previous items, wherein the article is a wafer dicing article.

Item 40. The abrasive article or method for making the abrasive article of any one of the previous items, wherein the article is an abrasive wheel selected from the group of abrasive wheel types consisting of type 1, type 41, type 1A8, type 1A1, type 1A1R, type 1B1, type 1E1, type 1EE1, type 1F1, type 1FF1, type 1V1, type 1V1P, and a combination thereof.

Item 41. The abrasive article or method for making the abrasive article of any one of the previous items, wherein the article has a substantially uniform thickness.

Item 42. The abrasive article or method for making the abrasive article of any one of the previous items, wherein the substantially uniform thickness is not greater than about 200 microns, not greater than about 150 microns, not greater than about 100 microns, not greater than about 90 microns, not greater than about 70 microns, not greater than about 65 microns, and at least about 1 micron, at least about 10 microns.

Item 43. The abrasive article or method for making the abrasive article of any one of the previous items, wherein the article comprises a first major surface, a second major surface, and a side surface extending between the first major surface and the second major surface, wherein the side surface defines a dimension of thickness between the first major surface and second major surface, wherein the article comprises an aspect ratio (D/t) of at least about 10, wherein D represents a diameter of the article and t represents the average thickness of the article, wherein the aspect ratio (D/t) is at least about 20, at least about 50, at least about 100.

Item 44. The abrasive article or method for making the abrasive article of any one of the previous items, wherein the article includes at least about 1 vol. % organic bond material for a total volume of the bond, at least about 5 vol. %, at least about 10 vol. %, at least about 15 vol. %, at least about 20 vol. %, at least about 25 vol. %, at least about 30 vol. %, and not greater than about 55 vol. %, not greater than about 50 vol. %, not greater than about 45 vol. %, not greater than about 40 vol. %, not greater than about 35 vol. %, not greater than about 30 vol. %.

Item 45. The abrasive article or method for making the abrasive article of any one of the previous items, wherein the article includes a greater content (vol. %) of the metal bond material compared to a content (vol. %) of the organic bond material, wherein the article comprises substantially the same content (vol. %) of metal bond material compared to a content (vol. %) of the organic bond material, wherein the article includes at least about 20 vol. % metal bond material for a total volume of the bond, at least about 30 vol. %, at least about 40 vol. %, at least about 45 vol. %, at least about 50 vol. %, at least about 55 vol. %, at least about 60 vol. %, and not greater than about 90 vol. %, not greater than about 85 vol. %, not greater than about 80 vol. %, not greater than about 75 vol. %, not greater than about 70 vol. %, not greater than about 65 vol. %, wherein the metal bond material is a continuous phase extending as an interconnected network of material throughout the volume of the article.

Item 46. The abrasive article or method for making the abrasive article of any one of the previous items, wherein the article comprises at least about 5 vol. % abrasive particles for a total volume of the article, at least about 10 vol. %, at least about 15 vol. %, at least about 20 vol. %, at least about 25 vol. %, at least about 30 vol. %, at least about 35 vol. %, and not greater than about 50 vol. %, not greater than about 45 vol. %, not greater than about 40 vol. %, not greater than about 35 vol. %, not greater than about 30 vol. %, not greater than about 25 vol. %.

Item 47. The abrasive article or method for making the abrasive article of any one of the previous items, wherein the article comprises about 10-13 vol. % of polyimide for a total volume of the article, about 68-72 vol. % of metal bond material for a total volume of the article, and about 16-20 vol. % of abrasive particles for a total volume of the article.

Item 48. The abrasive article or method for making the abrasive article of any one of the previous items, wherein the organic bond material consists essentially of particles having an average diameter of about 40 microns or less.

Item 49. The abrasive article or method for making the abrasive article of any one of the previous items, wherein the organic bond material comprises a polyimide, wherein the organic bond material comprises a resin, wherein the organic bond material comprises a phenolic resin, wherein the organic bond material comprises Vespel® SP1 polyimide, wherein the organic bond material comprises Mel din 7001 ® polyimide.

Item 50. The abrasive article or method for making the abrasive article of any one of the previous items, wherein the abrasive particle comprises a material selected from the group consisting of an oxide, a carbide, a nitride, a boride, an oxycarbide, an oxynitride, an oxyboride, diamond, a carbon-based material, and a combination thereof, wherein the abrasive particle comprises an agglomerated particle, wherein the abrasive particle consists essentially of diamond.

Item 51. The abrasive article or method for making the abrasive article of any one of the previous items, wherein the abrasive article is one or a multi-blade assembly that includes a plurality of abrasive articles in a gang configuration.

Item 52. The abrasive article or method for making the abrasive article of any one of the previous items, wherein the article comprises a porosity of not greater than about 10 vol. % for a total volume of the article.

Item 53. The abrasive article or method for making the abrasive article of any one of the previous items, wherein the hybrid bond forms a substantially continuous phase throughout the volume of the article, wherein the hybrid bond is in the form of interconnected channels of material extending throughout the volume of the article, wherein the organic bond material comprises a substantially discontinuous phase throughout the volume of the article.

Item 54. The abrasive article or method for making the abrasive article of any one of the previous items, wherein the metal bond further comprises a binary compound.

Item 55. The abrasive article or method for making the abrasive article of any one of the previous items, wherein the binary compound is an intermetallic phase.

Item 56. The abrasive article or method for making the abrasive article of any one of the previous items, wherein the metal bond further comprises a ternary compound.

Item 57. The abrasive article or method for making the abrasive article of any one of the previous items, wherein the ternary compound is a solid solution phase.

Item 58. The abrasive article or method for making the abrasive article of any one of the previous items, wherein the metal bond material comprises at least about 1 vol. % of the binary compound for a total volume of the metal bond material, at least about 2 vol. %, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % and 99 vol. % for the total volume of the metal bond.

Item 59. The abrasive article or method for making the abrasive article of any one of the previous items, wherein the metal bond material comprises not greater than 100 vol. % of the binary compound for a total volume of the metal bond material, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. %, and not greater than about 2 vol. %.

Item 60. The abrasive article or method for making the abrasive article of any one of the previous items, wherein the metal bond material comprises at least about 1 vol. % of the ternary compound for a total volume of the metal bond material, at least about 2 vol. %, at least about 5 vol. %, at least about 10 vol. %, at least about 15 vol. %, at least about 20 vol. %, at least about 25 vol. %, at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. %, at least about 80 vol. %, at least about 85 vol. %, at least about 90 vol. %, at least about 95 vol. % and 99 vol. % for the total volume of the metal bond.

Item 61. The abrasive article or method for making the abrasive article of any one of the previous items, wherein the metal bond material comprises not greater than 100 vol. % of the ternary compound for a total volume of the metal bond material, not greater than about 99 vol. %, not greater than about 97 vol. %, not greater than about 90 vol. %, not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. %, not greater than about 35 vol. %, not greater than about 30 vol. %, not greater than about 25 vol. %, not greater than about 20 vol. %, not greater than about 15 vol. %, not greater than about 10 vol. %, not greater than about 5 vol. %, and not greater than about 2 vol. %.

Item 62. The abrasive article or method for making the abrasive article of any one of the previous items, wherein the metal bond material comprises a ratio (CBC/CTC) of not greater than about 100, where CBC represents the content of binary compound in the metal bond in vol. % for the total volume of the metal bond and CTC represents the content of ternary compound in the metal bond in vol. % for total volume of the metal bond, not greater than about 90, not greater than about 80, not greater than about 70, not greater than about 60, not greater than about 50, not greater than about 40, not greater than about 30, not greater than about 20, not greater than about 10, not greater than about 9, not greater than about 8, not greater than about 7, not greater than about 6, not greater than about 5, not greater than about 4, not greater than about 3 and not greater than about 2, not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01, not greater than about 0.005, and not greater than about 0.001.

Item 63. The abrasive article or method for making the abrasive article of any one of the previous items, wherein the metal bond material comprises a ratio (CBC/CTC) of at least about 0.001, where CBC represents the content of binary compound in the metal bond in vol. % for the total volume of the metal bond and CTC represents the content of ternary compound in the metal bond in vol. % for total volume of the metal bond, at least about 0.005, at least about 0.01, at least about 0.05, at least about 0.1, at least about 0.2, at least about 0.3, at least about 0.4, at least about 0.5, at least about 0.6, at least about 0.7, at least about 0.8, at least about 0.9, at least about 1, at least about 2, at least about 3, at least about 4, at least about 5, at least about 10, at least about 20, at least about 30, at least about 40, at least about 50, at least about 60, at least about 70, at least about 80, at least about 90, at least about 99. The method for making a multifunction abrasive article of item 11, wherein the step of forming the mixture into a multifunction article further comprises cooling the molded article to form the abrasive article.

Item 64. The method for making a multifunction abrasive article of item 11, wherein the step of forming the mixture into a multifunction article further comprises lapping sides of the abrasive article to provide desired degree of straightness and a thickness of 250 microns or less.

Item 65. The method for making a multifunction abrasive article of item 64, wherein lapping is performed as double-sided lapping so that opposing sides of the abrasive article are simultaneously lapped.

What is claimed is:

1. An abrasive article, comprising:

a hybrid bond comprising a metal bond material and an organic bond material;

abrasive particles contained within the hybrid bond;

wherein the article has an average thickness of 250 microns or less; and wherein the metal bond material comprises:

a solid solution phase comprising silver, tin and copper;

an intermetallic phase comprising $Ag_3Sn$, and wherein the metal bond material comprises at least 15 vol. % of the intermetallic phase for a total volume of the metal bond material, and wherein the metal bond material comprises a ratio ($C_{BC}/C_{TC}$) of at least about 0.1 and not greater than about 1, where $C_{BC}$ represents the content of binary compound in the metal bond in vol. % for the total volume of the metal bond and $C_{TC}$ represents the content of ternary compound in the metal bond in vol. % for total volume of the metal bond.

2. The abrasive article of claim 1, wherein the metal bond material comprises at least 50 vol. % and not greater than 75 vol. % of the solid solution phase for a total volume of the metal bond material, and further wherein the metal bond material comprises at least 25 vol. % and not greater than 50 vol. % of the intermetallic phase for a total volume of the metal bond material.

3. The abrasive article of claim 1, wherein the metal bond material comprises not greater than about 10 vol. % of an elemental phase for a total volume of the metal bond material.

4. The abrasive article of claim 1, wherein the metal bond material comprises at least one of:

a ratio ($C_{SS}/C_{IM}$) of at least about 1 and not greater than about 5, where $C_{SS}$ represents the content of solid solution phase in the metal bond in vol. % for the total volume of the metal bond and $C_{IM}$ represents the content of intermetallic phase in the metal bond in vol. % for total volume of the metal bond;

a ratio ($C_E/C_{IM}$) of not greater than about 0.1, where $C_E$ represents the content of element phase in the metal bond in vol. % for the total volume of the metal bond and $C_{IM}$ represents the content of intermetallic phase in the metal bond in vol. % for total volume of the metal bond;

a ratio ($C_E/C_{SS}$) of not greater than about 0.1, where $C_E$ represents the content of element phase in the metal bond in vol. % for the total volume of the metal bond and $C_{SS}$ represents the content of solid solution phase in the metal bond in vol. % for total volume of the metal bond; or a combination thereof.

5. The abrasive article of claim 1, wherein the article is an abrasive wheel selected from the group of abrasive wheel types consisting of type 1, type 41, type 1A8, type 1A1, type 1A1R, type 1B1, type 1E1, type 1EE1, type 1F1, type 1FF1, type 1V1, type 1V1P, and a combination thereof.

6. The abrasive article of claim 1, wherein the article comprises about 10-13 vol. % of polyimide for a total volume of the article, about 68-72 vol. % of metal bond material for a total volume of the article, and about 16-20 vol. % of abrasive particles for a total volume of the article.

7. The abrasive article of claim 1, wherein the metal bond material comprises at least about 25 vol. % and not greater than 45 vol. % of a binary compound for a total volume of the metal bond material, and wherein the metal bond material comprises at least 55 vol. % and not greater than about 75 vol. % of a ternary compound for a total volume of the metal bond material.

8. The abrasive article of claim 1, wherein the abrasive article is a bonded abrasive article.

9. The abrasive article of claim 1, wherein the hybrid bond comprises at least 50 vol. % and not greater than 75 vol. % of the metal bond material for a total volume of the hybrid bond, and at least 25 vol. % and not greater than 50 vol. % of the organic bond material for a total volume of the hybrid bond.

10. An abrasive article, comprising:

a hybrid bond comprising a metal bond material and an organic bond material;

abrasive particles contained within the hybrid bond;

wherein the article has an average thickness of 250 microns or less; and wherein the metal bond material comprises:

a solid solution phase having a fracture toughness of at least 3 MPa·m.0.5 and not greater than about 8 MPa·m.0.5, wherein the solid solution phase comprises silver, tin and copper;

an intermetallic phase distinct from the solid solution phase having a fracture toughness of at least 3 MPa·m.0.5 and not greater than about 5 MPa·m.0.5, wherein the intermetallic phase comprises $Ag_3Sn$; and a ratio ($C_{SS}/C_{IM}$) of at least about 1 and not greater than about 5, where $C_{SS}$ represents the content of solid solution phase in the metal bond in vol. % for the total volume of the metal bond and $C_{IM}$ represents the content of intermetallic phase in the metal bond in vol. % for total volume of the metal bond; and wherein the metal bond material comprises at least 50 vol. % and not greater than 75 vol. % of the solid solution phase for a total volume of the metal bond material, and further wherein the metal bond material comprises at least 25 vol. % and not greater than 50 vol. % of the itermetallice phase for a total volume of the metal bond material.

11. The abrasive article of claim 10, wherein the solid solution phase has an average Vickers hardness of at least 1 GPa and not greater than about 5 GPa.

12. The abrasive article of claim 10, wherein the intermetallic phase has an average Vickers hardness of at least 2 GPa and not greater than about 4 GPa.

13. The abrasive article of claim 10, further comprising a porosity of not greater than about 10 vol. % for a total volume of the abrasive article.

14. The abrasive article of claim 10, wherein the metal bond material comprises not greater than about 10 vol. % of an elemental phase for a total volume of the metal bond material.

15. The abrasive article of claim 10, wherein the metal bond material comprises at least one of:

a ratio ($C_E/C_{IM}$) of not greater than about 0.1, where $C_E$ represents the content of element phase in the metal bond in vol. % for the total volume of the metal bond and $C_{IM}$ represents the content of intermetallic phase in the metal bond in vol. % for total volume of the metal bond;

a ratio ($C_E/C_{SS}$) of not greater than about 0.1, where $C_E$ represents the content of element phase in the metal bond in vol. % for the total volume of the metal bond and $C_{SS}$ represents the content of solid solution phase in the metal bond in vol. % for total volume of the metal bond; or a combination thereof.

* * * * *